United States Patent [19]

Hay

[11] Patent Number: 5,046,442

[45] Date of Patent: Sep. 10, 1991

[54] STANDOFF MOORING BAR FOR BOATS

[76] Inventor: Duff M. Hay, 1509 Lake Holiday, Sandwich, Ill. 60548

[21] Appl. No.: 482,772

[22] Filed: Feb. 21, 1990

[51] Int. Cl.[5] ..... B63B 17/00; B63B 21/00

[52] U.S. Cl. ..... 114/230; 403/109

[58] Field of Search ..... 114/230, 221 R; 403/109, 377; 188/67

[56] References Cited

U.S. PATENT DOCUMENTS

| | | | |
|---|---|---|---|
| 1,357,714 | 11/1920 | Lane | 403/109 X |
| 3,062,169 | 11/1962 | Cook | 114/230 |
| 3,199,818 | 8/1965 | Ahara | 403/109 |
| 3,741,514 | 6/1973 | Snurr | 403/377 X |
| 4,781,138 | 11/1988 | Hay | 114/230 X |

*Primary Examiner*—Sherman Basinger

[57] ABSTRACT

A standoff mooring bar for a boat featuring an adjustable mooring bar body that is automatically locked at the desired mooring length when a mooring rope is tensioned. This body has an inner cylindrical tube telescoping within an outer cylindrical tube, and a pair of end caps closing the telescoping pair of tubes. The mooring rope extends through the pair of tubes by passing through openings located in both end caps. An automatic locking assembly fixes the adjustable length of the telescoping pair of tubes when the tie ends of the mooring rope are secured during mooring. The locking assembly includes a locking tube located within the outer cylindrical tube, and a locking rope anchored to the internal end of the inner cylindrical tube which extends over the locking tube for insertion within the mooring rope. The locking rope is fixed to one of the exposed tie ends of the mooring rope. A guy rope is fixed to the mooring bar in such a manner that the guying forces do not tend to alter the combined length of the two telescoped tubes.

6 Claims, 2 Drawing Sheets

STANDOFF MOORING BAR FOR BOATS

This invention relates to a telescoping bar for boats which can be adjusted to moor a boat at various distances from a dock and which is automatically locked at the adjusted length for mooring.

BACKGROUND OF THE INVENTION

It is commonplace to moor a boat to a dock or to another boat. Severe weather conditions, such as rough water or turbulent winds can buffet the boat excessively, causing damage, or even loss of the boat.

The prior art relating to devices for mooring a boat is extensive. This art includes bumpers or fenders which may be attached either to the boat or to a dock to prevent the boat from being damaged by hitting against the dock due to the action of wind and waves. However, these bumpers rub and scuff the boat often causing moderate but permanent damage to the boat.

Accordingly, mooring devices were developed which separate the boat from the structure to which it is moored. Most of these devices employ a rigid elongated body which is used as a separating bar to cause a boat to standoff from its dock. U.S. Pat. Nos. 2,938,492, 3,224,404, 3,863,591 and 3,878,808 disclose typical structures having bars of constant length. U.S. Pat. Nos. 2,558,174 and 3,406,651 disclose mooring of several, discrete varying lengths produced by telescoping one element within another. However, these telescoping bars are not infinitely adjustable within the minimum and maximum lengths. Additionally, they are cumbersome to apply in certain docking situations because the length of the rope guy varies with the length of the mooring bar.

The inventor's U.S. Pat. No. 4,781,138 discloses a standoff mooring bar which is infinitely variable between minimum and maximum lengths This mooring bar employs a compression locking assembly to fix the adjustable length of a telescoping pair of tubes. The compression locking assembly must be manually locked. The resulting lock can be broken in response to extreme forces developed during mooring.

SUMMARY OF THE INVENTION

Accordingly, a principal object of this invention is to provide a simple mooring bar, which is easy to apply, which can be manually adjusted to any length between its minimum and maximum limits of length, and which is automatically locked at the manually adjusted length.

Another object is to increase the ability of an infinitely adjustable mooring bar to withstand forces developed during mooring which would alter the length of the mooring bar by collapsing the bar.

A preferred embodiment of the standoff mooring bar of this invention features an inner cylindrical plastic tube telescoping within an outer cylindrical plastic tube. Both ends of the telescoping pair of tubes are closed by plastic end caps. A single length of mooring rope passes through the composite bore defined by both tubes with a tie end emerging from a hole located in each end cap.

An automatic locking assembly fixes the adjustable length of the telescoping pair of tubes when the tie ends of the mooring rope are secured during mooring. The locking assembly includes a locking tube located within the outer cylindrical tube, and a locking rope anchored to the internal end of the inner cylindrical tube to extend over the locking tube for insertion within the mooring rope. The locking rope is fixed to one of the tie ends of the mooring rope.

When the tie ends of the mooring rope are secured during mooring and after the telescoping tubes are adjusted to the proper standoff distance, the tubes are automatically locked against collapsing at the required distance. No manual insertion of lock pins or the rotation of locking parts is required.

A guy rope, which prevents swaying of a boat to which a pair of mooring bars are attached, is secured around the inner tube and through the outer tube. Since the guy rope is always a fixed distance from the end of the outer tube of the mooring bar, the length of guy rope required for a given boat and dock will not vary regardless of different mooring distances. Additionally, the particular mode of guy rope attachment to the inner tube is so isolated from the automatic locking assembly that the guying forces do not tend to break the lock, and thus alter the length of the mooring bar. The guying forces enhance the lock.

DESCRIPTION OF THE DRAWINGS

In order that all of the structural features for attaining the objects of this invention may be readily understood, reference is made to the accompanying drawings in which.

DETAILED DESCRIPTION OF THE PREFERRED EMBODIMENT

Figure 1:
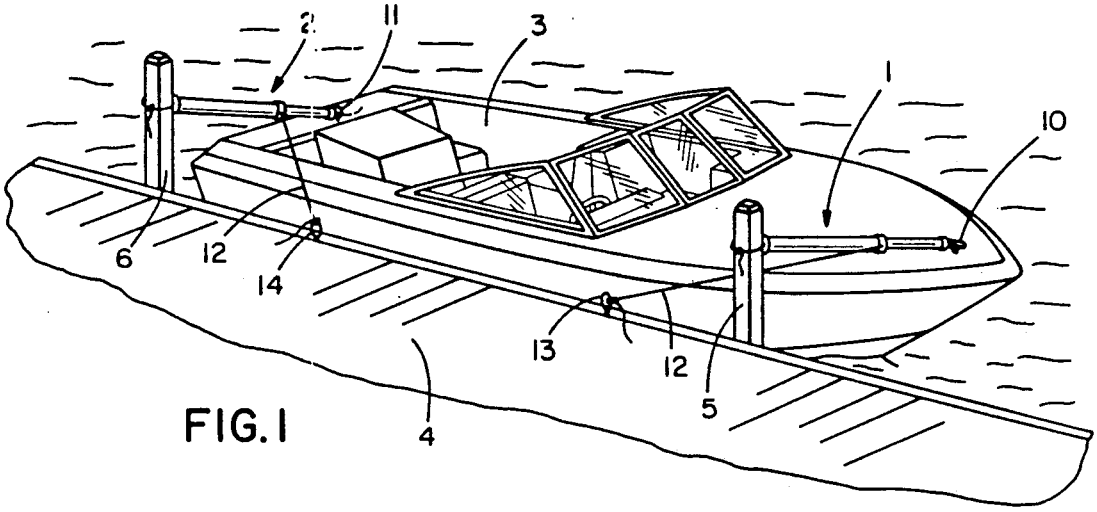
FIG. 1 is a perspective view showing the application to a boat of a pair of the standoff mooring bars of this invention.
Figure 2:
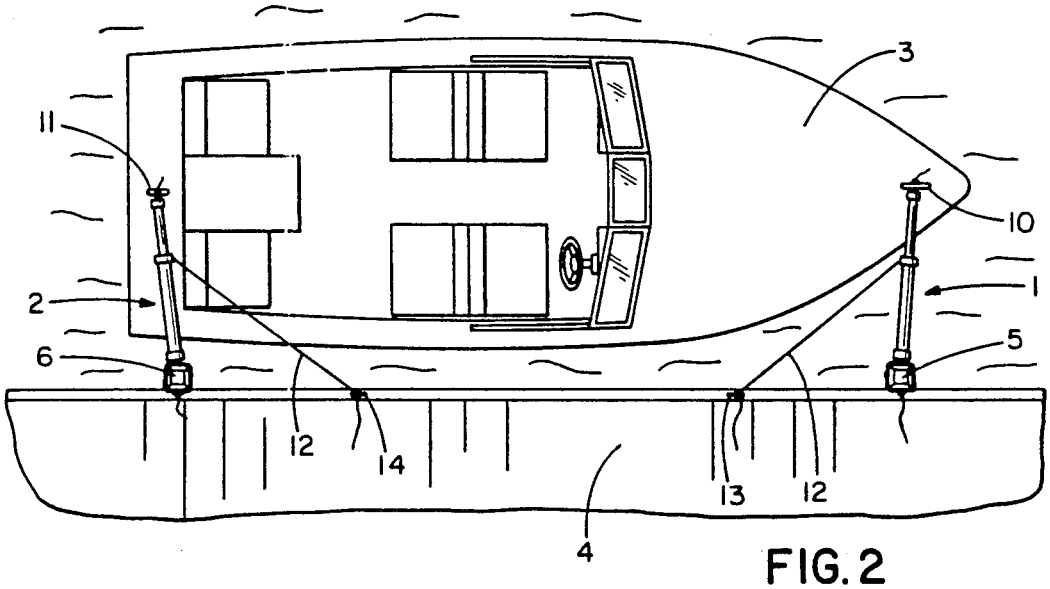
FIG. 2 is a plan view of the structure of FIG. 1.
Figure 3:
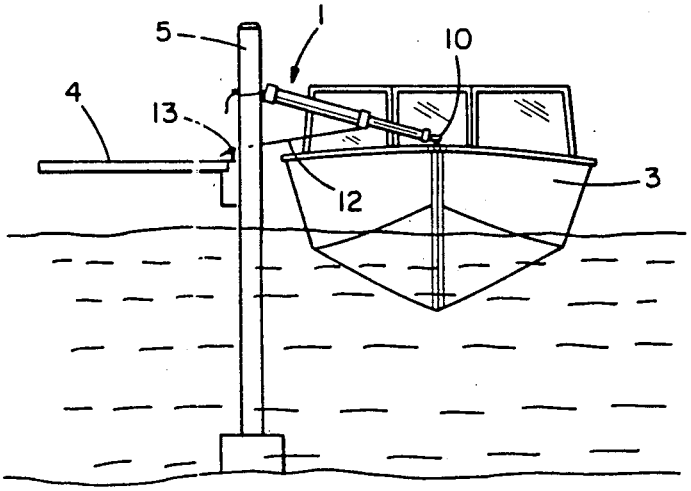
FIG. 3 is a bow end view of the structure of FIGS. 1 and 2.

FIGS. 1-3 of the drawings show a typical application of a pair of standoff mooring bars 1 and 2 of this invention in securing boat 3 to a dock 4 and a pair of docking posts 5 and 6.

Each mooring bar 1 and 2 is adjustable in length to provide a standoff distance which moors boat 3 out of contact with dock 4 to avoid damaging the hull of the boat.

Figure 4:
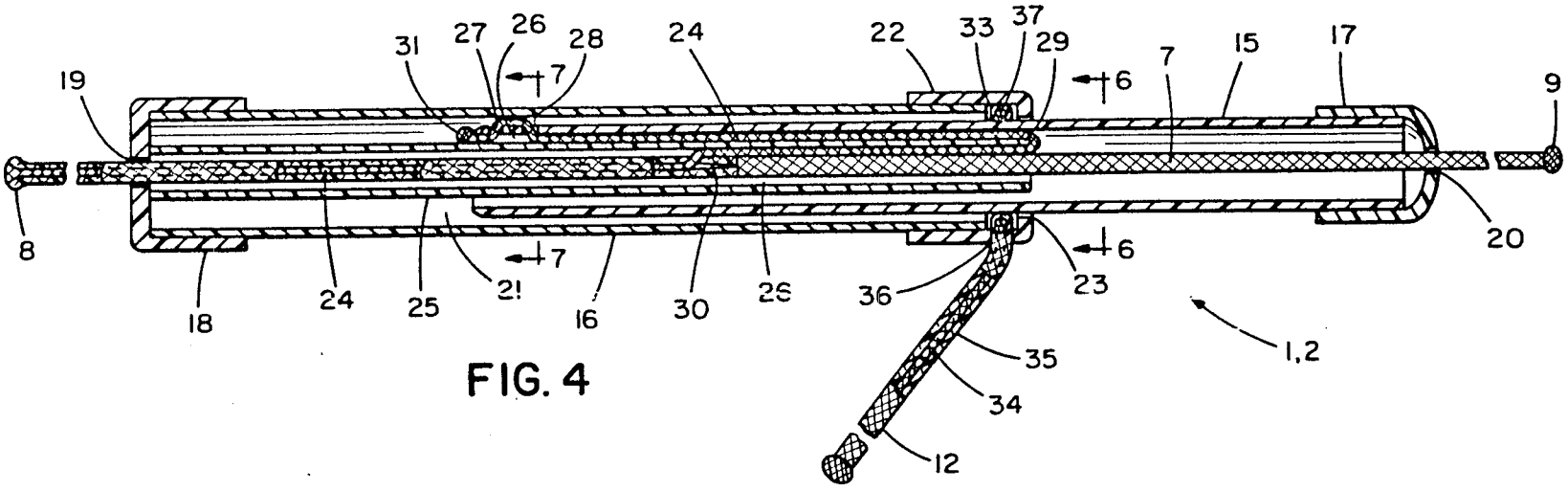
FIG. 4 is a section view of a single standoff mooring bar of this invention in an extended adjustment.
Figure 5:
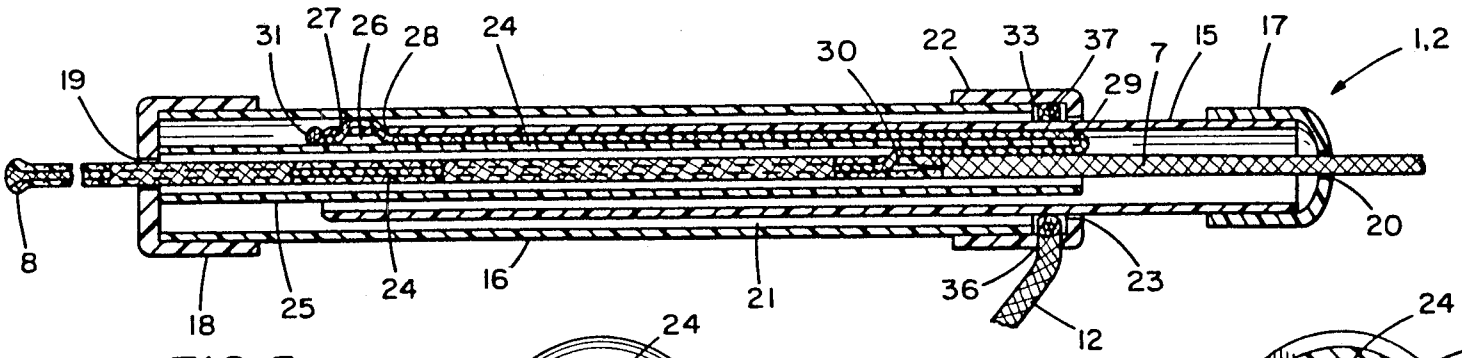
FIG. 5 is a section view which shows the structure of FIG. 4 in a contracted adjustment.
Figure 6:
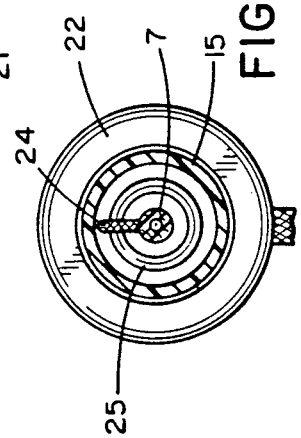
FIG. 6 is a section view taken along line 6—6 of FIG. 4.
Figure 7:
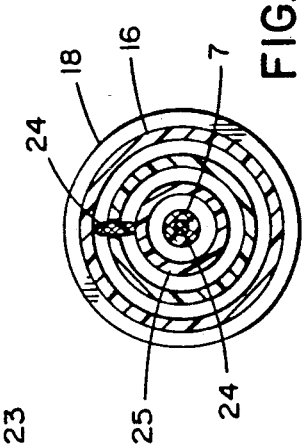
FIG. 7 is a section view taken along line 7—7 of FIG. 4.

As is best shown in FIGS. 4 and 5, a mooring rope 7 passes through the central bore of each mooring bar so that rope tie ends 8 and 9 project out of the device. Tie ends 9 of each bar 1 and 2 are secured to boat cleats 10 and 11, and tie ends 8 are secured to docking posts 5 and 6.

A first guy rope 12 extends between mooring bar 1 and docking ring 13, and a second guy rope 12 extends between mooring bar 2 and docking ring 14. This arrangement of guy ropes and mooring bars establishes a pair of triangles which prevent boat 3 from swaying relative dock 4.

Mooring bars 1 and 2 have an identical construction which is shown in detail in FIG. 4. Each bar has a body which has a manually adjustable length which is automatically locked at that length when the tie ends are secured. The body is formed by telescoping an inner cylindrical plastic tube 15 within outer tube 16. The exposed end of inner tube 15 is permanently closed by plastic end cap 17, and the opposite exposed end of outer tube 16 is permanently closed by plastic end caps 18 and 22. Tubes 15 and 16, and end caps 17, 18 and 22 may be fabricated from polyvinyl chloride, and the end caps glued to their associated tubes. In certain boat mooring situations it may be advisable to use two or more mooring bars having outer tubes 16 of different lengths and/or inner tubes 15 of different lengths.

Each end cap 17 and 18 has a central hole 20 and 19, respectively. Braided mooring rope 7 passes through holes 19 and 20, and cavity 21 formed by the composite bores of tubes 15 and 16. End cap 22 has a central hole 23 through which tube 15 passes.

The length of each mooring bar 1 and 2 is adjusted as desired for the proper mooring distance by manually varying the extent of telescoping insertion of inner tube 15 within outer tube 16. The selected length is maintained in compression (i.e. against collapsing of the mooring bar, but not against extension of the mooring bar) by the tension in locking rope 24 acting compressively on locking tube 25 and in tension by the tension in rope 7 between the terminations at boat cleats 10 and 11, and at docking posts 5 and 6. Locking tube 25 is seated loosely within inner and outer tubes 15 and 16 and is centered via rope 7. When locking rope 24 is under tension, locking tube 25 is seated against end cap 18. The inner end 29 of locking tube 25 forms a fixed rounded edge for locking rope 24 to return (or fold) upon itself This return or fold enables the locking rope to prevent collapsing of the mooring bar.

The inner end portion 31 or rope 24 passes through the annular space 26 between cylindrical tubes 15 and 25, through two holes 27 and 28 in tube 15, and terminates in an enlargement of the rope outside the inner end of tube 15. The tension in locking rope 24 is created and maintained primarily by the seating of enlarged end 31 against the end of tube 15 because enlarged end 31 cannot pass through the annular space between tubes 15 and 25, and also by the friction between rope 24 passing through holes 27 and 28. This annular space is further restricted due to the deformation of tube 15 between the two holes 27 and 28 and at end 31 resulting from the tension on rope 24.

The other end of locking rope 24 is inserted into an opening 30 formed between the expanded interstices of mooring rope 7 and is passed through the bore of the braid of rope 7. This end is terminated as part of the termination of tie end 8. A pulling force exerted on mooring rope 7 extending tie end 8 away from the body of the mooring bar, causes locking rope 24 to seat locking tube 25 against end cap 18.

Components 24 and 25 comprise an automatic locking assembly which operates as follows during a mooring operation. Initially, tubes 15 and 16 are manually adjusted to the required standoff mooring distance. Thereafter, the exposed end of mooring rope 7 containing locking rope 24 (tie end 8) is manually pulled to seat locking tube 25 as shown in FIG. 4. (It is important that tie end 8 be tied off before tie end 9.) Tie end 8 is then tied off on docking post 5 or 6, and the opposite end 9 of mooring rope 7 is thereafter placed under tension manually during tie off on cleat 10 or 11. When rope 7 is tensioned at both ends 8 and 9 tubes 15 and 16 are automatically locked against collapsing.

Braided guy rope 12 is secured to mooring bars 1, 2 by forming it into a ring loop 37 which is lodged within an annular cavity 33 which envelops inner tube 15. The overlapping and contacting surfaces of outer tube 16 and end cap 22 are glued together so as to form the space required to define annular cavity 33. Ring loop 37 may be easily formed by inserting one end 34 of braided guy rope 12 between expanded interstices of rope 12 and into the bore of the braid so that exterior braid section 35 tension locks upon the inserted braid portion 34. (This lock is sometimes called a "Chinese" lock.) End cap 22 has a hole 36 through which guy rope 12 projects.

A feature of the guying attachment of ring loop 37 is that the guying force increases the friction between inner and outer tubes 15 and 16 and end cap 22. This increased friction enhances these tubes to maintain reliably their composite telescoped fixed length.

A principal difference of the present design over that covered in the inventor's U.S. Pat. No. 4,781,138 is the locking feature of the two telescoping tubes which automatically fixes the selected length against collapsing. The compression locking assembly of U.S. Pat. No. 4,781,138 has a more limited force that can be withstood in compression. The present design can work in conjunction with the compression locking assembly of U.S. Pat. No. 4,781,138 (not shown), or entirely by itself as shown in FIGS. 4 and 5. The locking strength in compression of the present design is based on the breaking strength of rope 24 in tension; and the locking strength in tension for the design of U.S. Pat. No. 4,781,138 and also the present design relies on the breaking strength of mooring rope 7 in tension.

The locking strength of my prior patented compression locking design relied on the amount of force exerted through a nut which was tightened by hand. In use, wet hands sometimes made it difficult to tighten or loosen the nut. The operation and ease of use of the new locking design of this specification is simple. The new design eliminates any physical tightening requirements for maximum locking. Utilizing the automatic locking feature of this invention, the diameters of the telescoping tubes are not limited by having either standard or custom molded locking assemblies which dictate the diameters; any size tubes which allows insertion within each other with clearance for lock rope 24 can be utilized. Higher strengths for larger boats can be accommodated easily with the new design of this invention.

The preferred embodiment previously described is illustrative of the principles of this invention. It should be understood, modifications can be made without departing from the scope of the invention.

What is claimed is:

1. A standoff mooring bar for a boat comprising an adjustable length mooring bar body having an elongated inner cylindrical tube telescoping within an elongated outer cylindrical tube, with each tube defining an elongated bore; a mooring rope extending through the bore of the telescoping pair of cylindrical tubes; and an automatic locking assembly fixing the adjustable length of the telescoping pair of tubes when subjected to a collapsing mooring force with the locking assembly including a generally cylindrical locking tube housed within a cavity defined by the inner and outer tubes and with the mooring rope also passing through a bore in the locking tube, and a flexible locking rope having one end portion anchored to the inner tube and the other rope end portion extending through the bore of the locking tube and fixed to the mooring rope so that the tensioning of the mooring rope causes the locking assembly to fix the relative position of the inner and outer tubes to prevent collapsing of the mooring bar.

2. The combination of claim 1 in which the mooring bar is infinitely adjustable lengthwise between its minimum and maximum lengths.

3. The combination of claim 2 comprising a guy rope fixed to the inner tube adjacent the end of the outer tube located between both ends of the mooring bar thereby isolating the lock established by the locking assembly from the guying force exerted by the guying rope.

4. A standoff mooring bar for a boat comprising an adjustable length mooring bar body having an elongated inner cylindrical tube telescoping within an elongated outer cylindrical tube, with each tube defining an elongated bore; a mooring rope extending through the bore of the telescoping pair of cylindrical tubes; and an automatic locking assembly fixing the adjustable length of the telescoping pair of tubes when subjected to a collapsing mooring force with the locking assembly including locking-rope guiding means housed within a cavity defined by the inner and outer tubes, and a flexible locking rope having one end portion anchored to the inner tube and the other rope end portion extending around the rope guiding means with the guiding means forming a fixed point for the locking rope to return upon itself and with the locking rope being fixed to the mooring rope so that the tensioning of the mooring rope causes the locking assembly to fix the relative position of the inner and outer tubes to prevent collapsing of the mooring bar.

5. The combination of claim 4 in which the mooring bar is infinitely adjustable lengthwise between its minimum and maximum lengths.

6. The combination of claim 5 comprising a guy rope surrounding the inner tube adjacent the end of the outer tube located between both ends of the mooring bar thereby isolating the lock established by the locking assembly from the guying force exerted by the guying rope.

* * * * *